US007353663B2

(12) United States Patent
Rafalovich et al.

(10) Patent No.: US 7,353,663 B2
(45) Date of Patent: Apr. 8, 2008

(54) EVAPORATOR ASSEMBLY FOR A REFRIGERATION DEVICE

(75) Inventors: Alexander P. Rafalovich, Louisville, KY (US); Sathi Bandaru, Louisville, KY (US); Yefim Tsozik, Louisville, KY (US)

(73) Assignee: General Electric Company, Schenectady, NY (US)

( * ) Notice: Subject to any disclaimer, the term of this patent is extended or adjusted under 35 U.S.C. 154(b) by 310 days.

(21) Appl. No.: 11/262,674

(22) Filed: Oct. 31, 2005

(65) Prior Publication Data

US 2007/0095089 A1 May 3, 2007

(51) Int. Cl.
*F25D 23/02* (2006.01)

(52) U.S. Cl. ..... 62/264; 362/92; 362/373

(58) Field of Classification Search ..... 62/264, 62/419, 426, 515–524; 362/92, 373, 154, 362/133, 136

See application file for complete search history.

(56) References Cited

U.S. PATENT DOCUMENTS

| | | | | |
|---|---|---|---|---|
| 2,056,041 | A * | 9/1936 | Erbach | 62/261 |
| 2,107,562 | A * | 2/1938 | Buchanan | 62/226 |
| 2,229,569 | A * | 1/1941 | Hoesel | 62/275 |
| 3,084,520 | A | 4/1963 | Jacobs | |
| 3,126,716 | A | 3/1964 | De Witte | |
| 3,572,049 | A * | 3/1971 | Moorman | 62/132 |
| 4,061,482 | A | 12/1977 | Smith | |
| 5,768,898 | A * | 6/1998 | Seok et al. | 62/132 |
| 5,839,507 | A | 11/1998 | Jensen | |
| 6,112,537 | A | 9/2000 | Broadbent | |
| 6,311,499 | B1 | 11/2001 | Broadbent | |
| 6,626,004 | B2 | 9/2003 | Lee | |
| 2005/0120727 | A1 | 6/2005 | Finner et al. | |

* cited by examiner

*Primary Examiner*—William E. Tapolcai
(74) *Attorney, Agent, or Firm*—George L. Rideout, Esq.; Armstrong Teasdale LLP

(57) ABSTRACT

A refrigerator includes an evaporator assembly. The evaporator assembly includes an evaporator fan located in a refrigeration compartment of the refrigerator. The refrigerator evaporator assembly includes a fan cover at least partially enclosing the evaporator fan, the fan cover including a first side, a second side, a front, a back, and an air inlet. The refrigerator evaporator assembly also includes a light arranged in proximity to the air inlet such that air entering the evaporator fan is warmed by the light.

24 Claims, 6 Drawing Sheets

EVAPORATOR ASSEMBLY FOR A REFRIGERATION DEVICE

BACKGROUND OF THE INVENTION

This invention relates generally to refrigeration devices, and more particularly, to evaporator assemblies and methods for a refrigeration device.

Known refrigerators generally include a case defining at least one compartment for storage of food items, at least one door for closing the compartment, a light assembly including a light cover, and a condenser/cooling system configured to provide a refrigeration result in the compartment, i.e., remove a certain amount of heat energy from the compartment to the outside environment. The condenser system typically includes a compressor, a condenser, and an evaporator connected in series and charged with a refrigerant. An evaporator fan is used to improve heat transfer efficiency.

In operation, when the door of the refrigerator is opened by a user, the light turns on to illuminate the compartment. At the same time, outside air with moisture enters the evaporator fan. As a result, more and more air with moisture is condensed on the blades of the evaporator fan after a while, and then frosted due to the refrigerated environment. This may affect the performance of the evaporator fan, and even lead to damage of the evaporator fan.

In addition, light energy emitted from the light generates heat which may deform the light cover during the illumination. Thus, the service life of the light cover may be greatly reduced thereby increasing cost which is not desired either by consumers or by manufactures. Moreover, the lights and the evaporator fan of existing refrigerators are commonly located in different parts of the compartment. This structure takes more volume in the compartment of the refrigerator. Thus each take up space within the compartment.

BRIEF DESCRIPTION OF THE INVENTION

In one aspect, a refrigerator evaporator assembly is provided. The refrigerator evaporator assembly includes an evaporator fan located in a refrigeration compartment of the refrigerator. The refrigerator evaporator assembly includes a fan cover at least partially enclosing the evaporator fan, the fan cover including a first side, a second side, a front, a back, and an air inlet. The refrigerator evaporator assembly also includes a light arranged in proximity to the air inlet such that air entering the air inlet is warmed by the light.

In another aspect, a refrigerator is provided. The refrigerator includes a refrigeration compartment, an evaporator fan located in the refrigeration compartment, and at least one light arranged in proximity to the fan. The refrigeration compartment is configured to provide warmed air to the evaporator fan.

In still another aspect, a refrigerator is provided. The refrigerator includes a refrigeration compartment including an evaporator fan and a light. An evaporator is arranged outside the refrigeration compartment, and the evaporator is in flow communication with the evaporator fan which provides flow communication between the light and the evaporator.

In still another aspect, a refrigerator is provided. The refrigerator includes a refrigeration compartment including an evaporator fan and a light. An evaporator is arranged outside the refrigeration compartment and in flow communication with the fan which provides flow communication between the light and the evaporator. The refrigerator also includes a controller which is configured to control the operation of the refrigerator, and the controller is coupled to at least one of the evaporator fan and the light.

In still another aspect, a method of assembling an evaporator fan assembly is provided in a refrigerator having at least one refrigeration compartment. The method includes providing an evaporator fan in the refrigeration compartment, providing a fan cover with at least one air inlet to enclose the evaporator fan, and positioning a light in proximity to the air inlet, wherein the light is configured to illuminate the refrigeration compartment and warm air entering the evaporator fan from the refrigeration compartment.

DETAILED DESCRIPTION OF THE INVENTION

Figure 1:
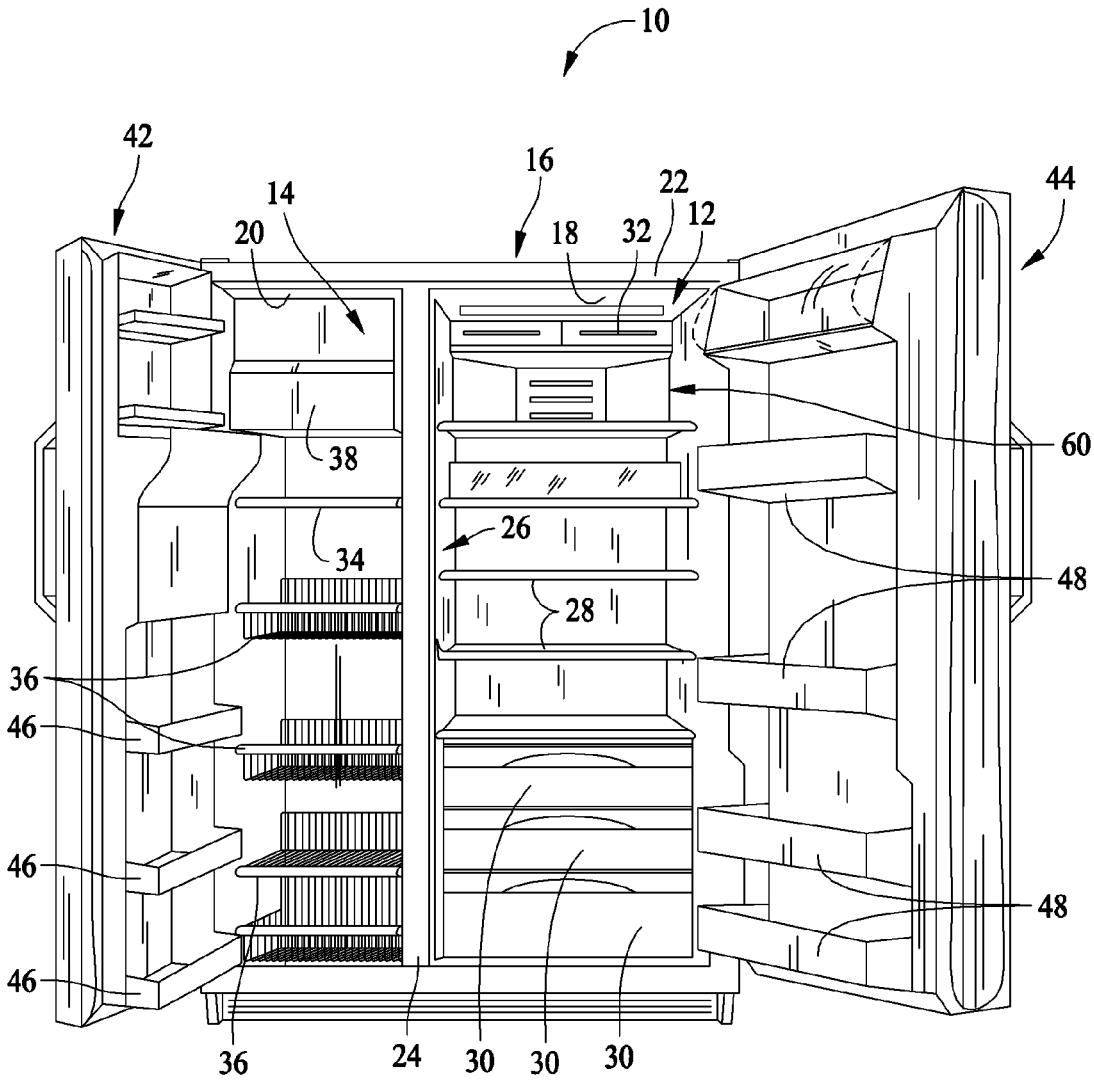
FIG. 1 illustrates an exemplary refrigerator in accordance with one embodiment of the present invention.

FIG. 1 illustrates an exemplary refrigeration appliance 10 in which the present invention may be practiced. In the embodiment described and illustrated herein, appliance 10 is a side-by-side refrigerator. It is recognized, however, that the benefits of the present invention are equally applicable to other types of refrigerators, freezers, and refrigeration appliances. Consequently, the description set forth herein is for illustrative purposes only and is not intended to limit the invention in any aspect.

Refrigerator 10 includes a fresh food storage compartment 12 and a freezer storage compartment 14. Fresh food compartment 12 and freezer compartment 14 are arranged side-by-side within an outer case 16 and are defined by inner liners 18 and 20 therein. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form top and side walls of case 16. A bottom wall of case 16 normally is formed separately and attached to the case side walls and to a bottom frame that provides support for refrigerator 10. Inner liners 18 and 20 are molded from a suitable plastic material to form fresh food compartment 12 and freezer compartment 14, respectively. Alternatively, liners 18, 20 may be formed by bending and welding a sheet of a suitable metal, such as steel. The illustrative embodiment includes two separate liners 18, 20 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 22 extends between a case front flange and outer front edges of liners 18, 20. Breaker strip 22 is formed from a suitable resilient material, such as an extruded acrylo-butadiene-styrene based material (commonly referred to as ABS).

The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26.

In addition, refrigerator 10 includes shelves 28 and slide-out storage drawers 30, sometimes referred to as storage pans, which normally are provided in fresh food compartment 12 to support items being stored therein.

Refrigerator 10 is controlled by a microprocessor (not shown) according to user preference via manipulation of a control interface 32 mounted in an upper region of fresh food storage compartment 12 and coupled to the microprocessor. A shelf 34 and wire baskets 36 are also provided in freezer compartment 14. In addition, an ice maker 38 may be provided in freezer compartment 14.

A freezer door 42 and a fresh food door 44 close access openings to fresh food and freezer compartments 12, 14, respectively. Each door 42, 44 is mounted to rotate about its outer vertical edge between an open position, as shown in FIG. 1, and a closed position (not shown) closing the associated storage compartment. Freezer door 42 includes a plurality of storage shelves 46, and fresh food door 44 includes a plurality of storage shelves 48.

Refrigerator 10 comprises a refrigerator evaporator assembly 60. In one exemplary embodiment, refrigerator evaporator assembly 60 is positioned under control interface 32 in fresh food compartment 12. In the other exemplary embodiment, refrigerator evaporator assembly 60 can also be positioned in freezer compartment 14. In another exemplary embodiment, two refrigerator evaporator assemblies 60 can be arranged in fresh food compartment 12 and freezer compartment 14, respectively.

Figure 2:
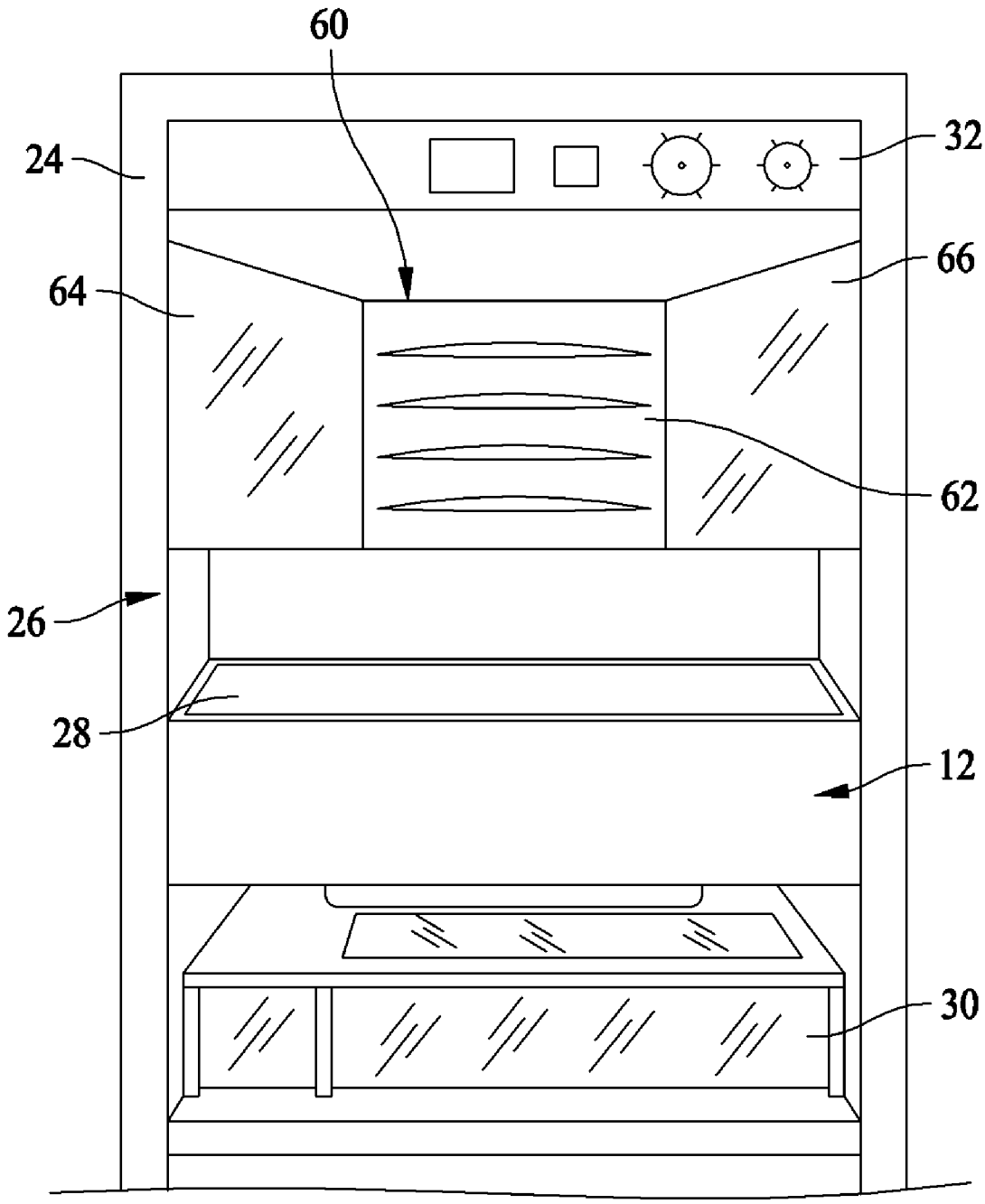
FIG. 2 is a partial schematic view of a fresh food compartment of the refrigerator shown in FIG. 1 including an exemplary refrigerator evaporator assembly.

FIG. 2 is a partial schematic view of fresh food compartment 12 of refrigerator 10 (shown in FIG. 1) including refrigerator evaporator assembly 60. Refrigerator evaporator assembly 60 includes a fan cover 62, a first light cover 64, and a second light cover 66. In one exemplary embodiment, fan cover 62 is connected with first light cover 64 and second light cover 66 at both sides thereof. In another embodiment, fan cover 62 is integrally formed with first light cover 64 and second light cover 66. In one exemplary embodiment, front surfaces of light covers 64, 66 are substantially flush with front sides of fan cover 62.

Figure 3:
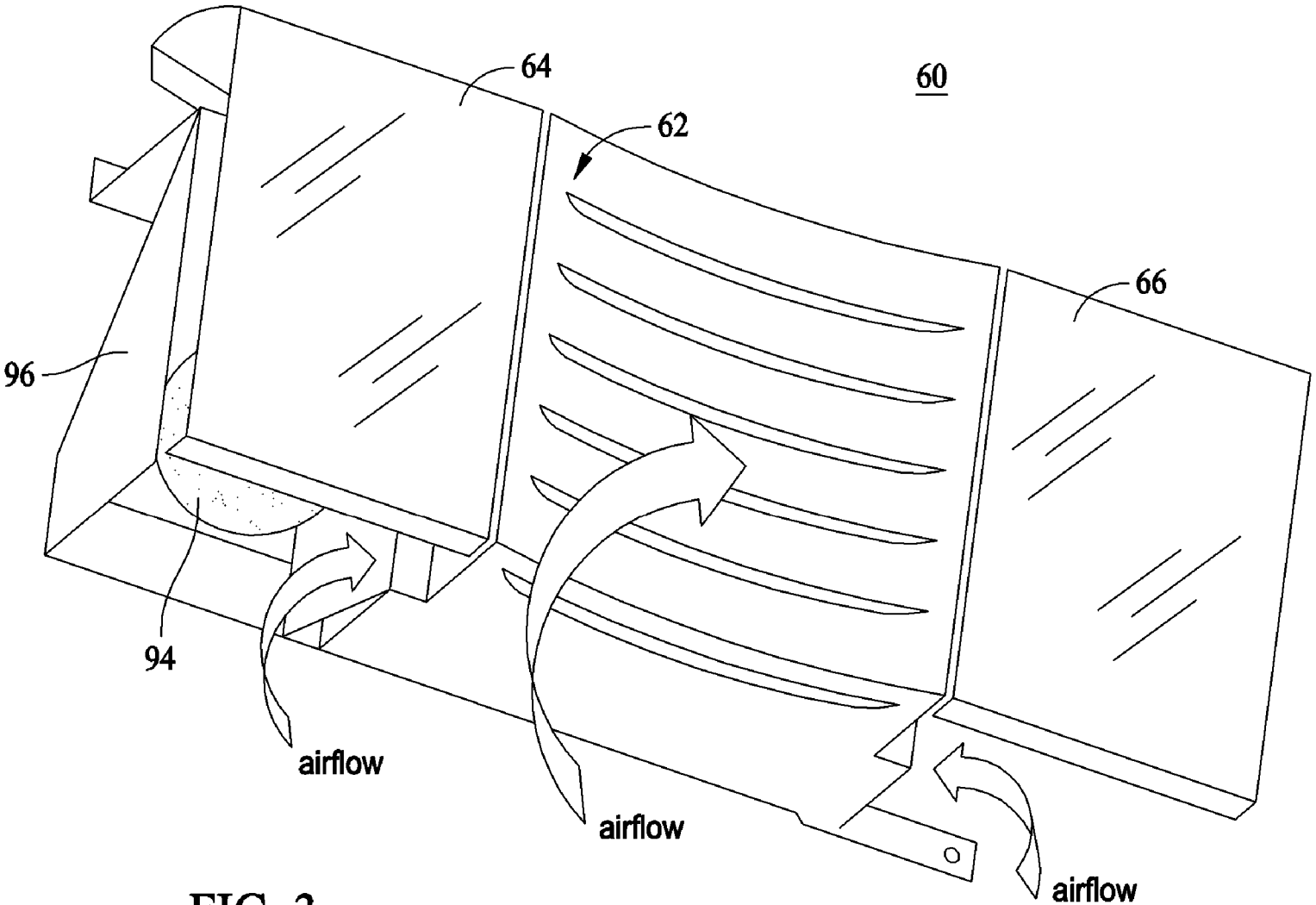
FIG. 3 is a perspective view of the refrigerator evaporator assembly shown in FIG. 2.
Figure 4:
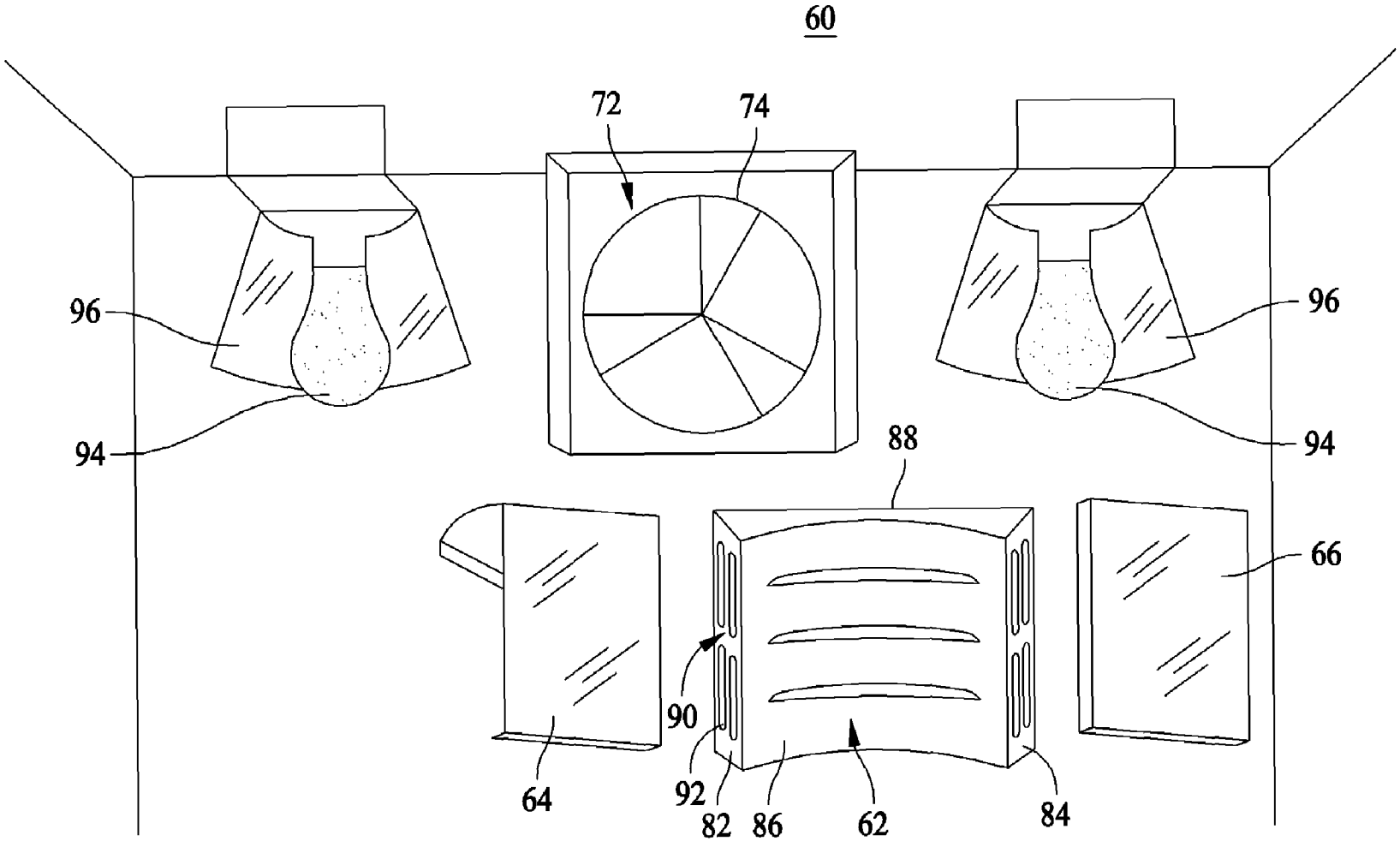
FIG. 4 is an exploded perspective view of the refrigerator evaporator assembly shown in FIG. 3.

FIG. 3 is a perspective view of refrigerator evaporator assembly 60, and FIG. 4 is an exploded perspective view of refrigerator evaporator assembly 60. Refrigerator evaporator assembly 60 also includes an evaporator fan 72 which is at least partially enclosed by fan cover 62. Evaporator fan 72 includes a plurality of blades 74 which may be made from stainless steel or plastic materials and a motor (not shown) for driving blades 74. As shown in FIG. 4, fan cover 62 includes a first side 82, a second side 84, a front 86, and a back 88. In one exemplary embodiment, an air inlet 90 includes a plurality of slots or through holes 92 defined through first side 82 and second side 84. In another embodiment, air inlet 90 includes a plurality of slots or through holes (not labeled) defined through front 86 which allow airflow to enter evaporator fan 72 from compartment 12.

Refrigerator evaporator assembly 60 also includes two light bulbs 94 and reflectors 96 configured to reflect light emitted from the light bulbs. Light bulbs 94 are positioned in front of reflectors 96 and are configured to illuminate fresh food compartment 12 when fresh food door 44 is open. In the exemplary embodiment, reflectors 96 are received in light covers 64, 66, surrounding light bulbs 94. Light bulbs 94 are arranged in proximity to both sides 82, 84 respectively such that air entering evaporator fan 72 through air inlet 90 is warmed by light bulbs 94.

Figure 5:
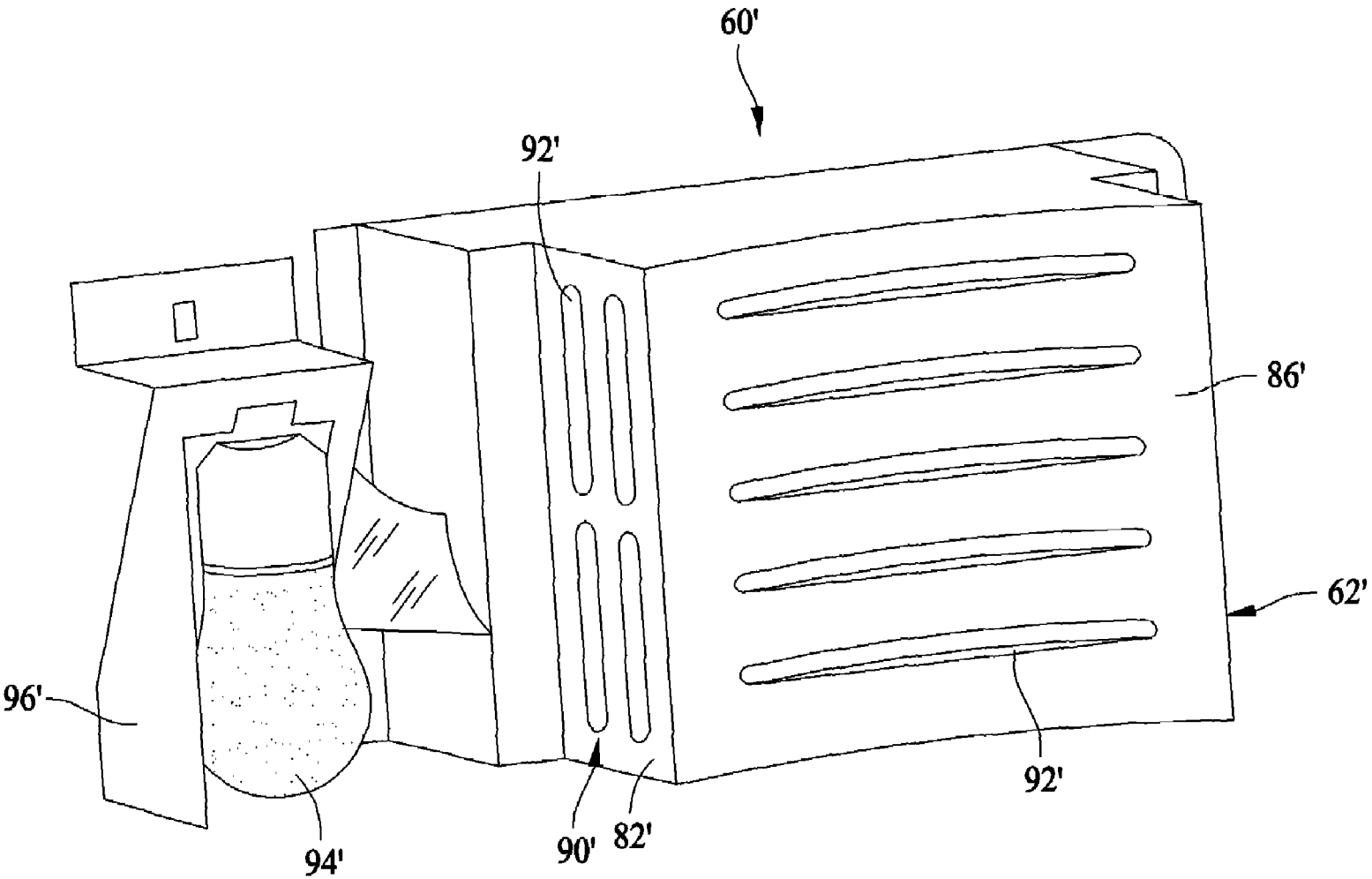
FIG. 5 is a perspective schematic view of the refrigerator evaporator assembly according to another embodiment of the present invention.

FIG. 5 is a perspective schematic view of a refrigerator evaporator assembly 100 according to another embodiment of the present invention. Elements in FIG. 5 that are identical to elements in FIG. 4 utilize the same reference numbers. Evaporator assembly 100 includes a fan cover 62 which at least partially encloses an evaporator fan (not shown), and a light bulb 94 is arranged in proximity to left side 82 of fan cover 62. In one exemplary embodiment, an air inlet 90 includes a plurality of slots 92 defined through left side 82. In the other exemplary embodiment, slots 92 are defined through front side 86 of fan cover 62. As such, light bulb 94 is positioned in proximity to slots 92, and air entering fan cover 62 is warmed by light bulb 94. The number and dimensions of slots 90 can be varied depending on the temperature of the air intended to enter fan cover 62. In another exemplary embodiment, slots 92 extending through front side 86 of fan cover 62 are eliminated.

Figure 6:
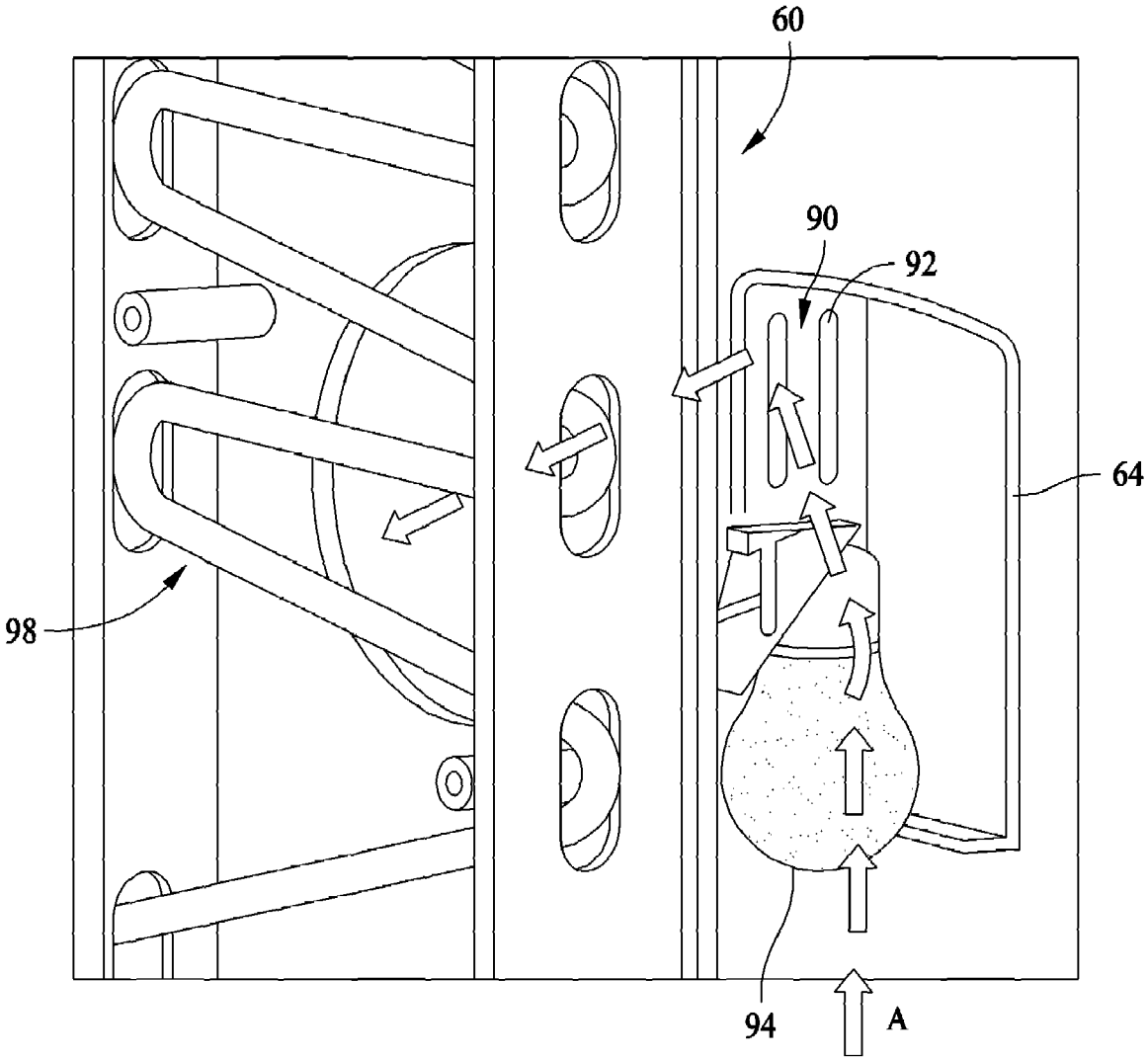
FIG. 6 is a partial side perspective view of the refrigerator evaporator assembly shown in FIG. 3.

FIG. 6 is a side perspective view of refrigerator evaporator assembly 60 shown in FIG. 3. In accordance with known refrigerators, refrigerator 10 includes a cooling system (not shown) for executing a known vapor compression cycle for cooling air. The cooling system generally includes a compressor (not shown), a condenser (not shown), and an evaporator 102 connected in series and charged with a refrigerant. Evaporator 102 is a type of heat exchanger which transfers heat from air passing over evaporator 102 to a refrigerant flowing through evaporator 102 thereby causing the refrigerant to vaporize. As such, cooled air is produced and configured to refrigerate compartments 12, 14. In one exemplary embodiment, evaporator 102 is positioned behind evaporator fan 72 (shown in FIG. 4) outside fresh food compartment 12 and in flow communication with evaporator fan 72 thereby providing an air flow communication between light bulb 94 and evaporator 102.

In the exemplary embodiment, the cooling system is operatively coupled to the microprocessor (not shown) of control interface 32 (shown in FIG. 1). Light bulb 94 is also operatively coupled to the microprocessor and connected with a power source (not shown), for example, a battery, via a wiring 104.

In operation, refrigerator 10 refrigerates food items stored in fresh food compartment 12 (shown in FIG. 2). When fresh food door 44 is open, light bulb 94 is turned on by the microprocessor (not shown) which allows a user to see the compartment. During this period, the compressor is typically off and evaporator fan 72 (shown in FIG. 4) is still working. As a result, outside air with moisture enters evaporator fan 72 from compartment 12. As shown in FIG. 6, outside air flows along a direction indicated by arrow A towards air inlet 90.

As light bulb 94 is arranged in proximity to air inlet 90 of evaporator fan 72, the incoming air flowing around light bulb 94 is warmed before entering evaporator fan 72 from fresh food compartment 12. As a result, the relative humidity of air is greatly reduced and light bulb 94 is cooled.

Therefore, evaporator fan 72 is less likely to build condensation and frost. Meanwhile, the heat generated by light bulb 94 is simultaneously reduced due to cool air contacting light cover 64 and light bulb 94 and the service life of light cover 64 is prolonged.

While the invention has been described in terms of various specific embodiments, those skilled in the art will recognize that the invention can be practiced with modification within the spirit and scope of the claims.

We claim:

1. An evaporator assembly for a refrigerator, said evaporator assembly comprising:

an evaporator fan located in a refrigeration compartment of the refrigerator;

a fan cover at least partially enclosing said evaporator fan, said fan cover comprising a first side, a second side, a front, a back, and an air inlet;

a light arranged in proximity to said air inlet such that air entering said air inlet is warmed by said light; and a light cover configured to cover at least a portion of said light, said light cover coupled to said fan cover.

2. The refrigerator evaporator assembly in accordance with claim 1 wherein at least one of said front side and said second side comprises said air inlet.

3. The refrigerator evaporator assembly in accordance with claim 2 wherein said light adjacent one of said sides.

4. The refrigerator evaporator assembly in accordance with claim 1 wherein a front surface of said light cover is substantially flush with a front side of said fan cover.

5. The refrigerator evaporator assembly in accordance with claim 1 further comprising a second light and a second light cover, both said covers coupled to said fan cover.

6. A refrigerator comprising:

a refrigeration compartment;

an evaporator fan located in said refrigeration compartment;

a fan cover covering at least a portion of said evaporator fan, said fan cover defining at least one air inlet;

a light arranged in proximity to said fan, said refrigeration compartment configured to provide warmed air to said fair; and a light cover configured to cover at least a portion of said light, said light cover coupled to said fan cover.

7. The refrigerator in accordance with claim 6 wherein said fan cover further comprises a first side and a second side, said at least one air inlet extending through one of said sides.

8. The refrigerator in accordance with claim 6 wherein said light adjacent said fan.

9. The refrigerator in accordance with claim 6 wherein a front surface of said light cover is substantially flush with a front side of said fan cover.

10. The refrigerator in accordance with claim 6 wherein a reflector is received in said light cover, surrounding said light.

11. The refrigerator in accordance with claim 6 wherein there are two light covers engaging with respective sides of said fan cover.

12. A refrigerator comprising:

a refrigeration compartment comprising an evaporator fan and a light;

an evaporator outside said refrigeration compartment and in flow communication with said fan, said evaporator fan providing flow communication between said light and said evaporator; and a fan cover at least partially covering said evaporator fan, said fan cover comprising a first side, a second side, a front, a back, and an air inlet.

13. The refrigerator in accordance with claim 12 wherein at least one of said front side and said second side comprises said air inlet.

14. The refrigerator in accordance with claim 12 wherein said light arranged in proximity to said air inlet such that air entering said air inlet is warmed by said light.

15. The refrigerator in accordance with claim 12 further comprising a light cover configured to cover at least a portion of said light, said cover coupled to said fan cover.

16. The refrigerator in accordance with claim 15 wherein a front surface of said light cover is substantially flush with a front side of said fan cover.

17. A refrigerator comprising:

a refrigeration compartment comprising an evaporator fan and a light;

an evaporator outside said refrigeration compartment and in flow communication with said evaporator fan, said evaporator fan providing flow communication between said light and said evaporator;

a fan cover at least partially covering said evaporator fan, said fan cover comprising a first side, a second side, a front, a back, and an air inlet; and a controller configured to control the operation of the refrigerator, said controller coupled to at least one of said evaporator fan and said light.

18. The refrigerator in accordance with claim 17 wherein at least one of said front side and said second side comprises said air inlet.

19. The refrigerator in accordance with claim 17 wherein said light arranged in proximity to said air inlet such that air entering said air inlet is warmed by said light.

20. The refrigerator in accordance with claim 17 further comprising a light cover configured to cover at least a portion of said light, said cover coupled to said fan cover.

21. The refrigerator in accordance with claim 20 wherein a front surface of said light cover is substantially flush with a front side of said fan cover.

22. A method of assembling an evaporator fan assembly in a refrigerator having at least one refrigeration compartment, said method comprising:

providing an evaporator fan in the refrigeration compartment;

providing a fan cover with at least one air inlet to enclose said evaporator fan;

providing a first plurality of slots through at least one side of said fan cover and a second plurality of slots through a front side of said fan cover; and positioning a light in proximity to said at least one air inlet, said light configured to illuminate the refrigeration compartment and warm air entering said evaporator fan from the refrigeration compartment.

23. The method of assembling an evaporator fan with a light assembly in accordance with claim 22 further comprising coupling at least one light cover to said fan cover.

24. The method of assembling an evaporator fan with a light assembly in accordance with claim 23 further comprising providing a reflector to at least partially surround the at least one light.

* * * * *

UNITED STATES PATENT AND TRADEMARK OFFICE

CERTIFICATE OF CORRECTION

PATENT NO. : 7,353,663 B2
APPLICATION NO. : 11/262674
DATED : April 8, 2008
INVENTOR(S) : Rafalovich et al.

It is certified that error appears in the above-identified patent and that said Letters Patent is hereby corrected as shown below:

In Claim 6, column 5, line 41, delete “fair; and” and insert therefor --fan; and--.

Signed and Sealed this

Thirtieth Day of June, 2009

JOHN DOLL
*Acting Director of the United States Patent and Trademark Office*